US006210220B1

(12) United States Patent
Zhu et al.

(10) Patent No.: US 6,210,220 B1
(45) Date of Patent: Apr. 3, 2001

(54) ELECTRICAL CONNECTOR

(75) Inventors: ZiQiang Zhu; Guohua Zhang; LunSong Hu; Hao Gu, all of Kun-San (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/467,089

(22) Filed: Dec. 10, 1999

(30) Foreign Application Priority Data

Nov. 2, 1998 (TW) ..... 88218638

(51) Int. Cl.[7] ..... H01R 13/73
(52) U.S. Cl. ..... 439/567
(58) Field of Search ..... 439/567, 571, 439/572, 607, 362

(56) References Cited

U.S. PATENT DOCUMENTS 5,733,142 * 3/1998 Clark ..... 439/567
5,807,135 * 9/1998 Clark ..... 439/567
6,012,954 * 1/2000 Wu ..... 439/567

* cited by examiner

*Primary Examiner*—Gary F. Paumen
(74) *Attorney, Agent, or Firm*—Wei Te Chung

(57) ABSTRACT

An electrical connector of the present invention comprises an insulative housing, a front shell, a pair of locking posts and a pair of integral-formed boardlocks. The insulative housing defines a pair of receiving recesses for engaging with the pair of boardlocks. Each receiving recess comprises a first slot and a second slot separated by a retaining body formed by the housing in the receiving recess. The pair of boardlocks each comprise a body section defining a screw portion used to function as a nut, a resilient section received in the first slot and abutting a rearward surface of a front wall of the housing, which is used to function as a washer, and a board-locking section retained in the second slot. Thus the boardlocks are adapted for simplifying the manufacture and assembly thereof and reducing the cost of production, compared with the prior art.

1 Claim, 5 Drawing Sheets

ELECTRICAL CONNECTOR

BACKGROUND OF THE INVENTION

The present invention relates to an electrical connector, and particularly to an electrical connector which provides a securing device for mounting the electrical connector to a printed circuit board.

An electrical connector usually includes boardlocks for mounting the connector onto a printed circuit board, and locking posts each of which has a threaded hole for threadedly engaging with a bolt of a mating connector, and a threaded stud extending through a corresponding boardlock and a washer to threadedly engage with a nut. Thus, the boardlocks and the locking posts are fastened to the electrical connector. The washers and nuts increase the component and inventory cost. Furthermore, to mount the washers and nuts to the connector complicates the assembling operation.

Hence, an improved electrical connector is required to overcome the disadvantages of the prior art.

BRIEF SUMMARY OF THE INVENTION

A first object of the present invention is to provide an electrical connector which provides a securing member having retaining and locking functions;

A second object of the present invention is to provide an electrical connector which provides a securing member being integrally formed and reducing the quantity of the elements thereof and the production cost.

An electrical connector of the present invention comprises an insulative housing, a front shell, a pair of locking posts and a pair of integral-formed boardlocks. The insulative housing defines a pair of receiving recesses for engaging with the pair of boardlocks. Each receiving recess comprises a first slot and a second slot separated by a retaining body formed by the housing in the receiving recess. The pair of boardlocks each comprise a body section defining a screw portion used to function as a nut, a resilient section received in the first slot and abutting a rearward surface of a front wall of the housing, which is used to function as a washer, and a board-locking section retained in the second slot. Thus the boardlocks are adapted for simplifying the manufacture and assembly thereof and reducing the cost of production by omission of the nut and the washer, compared with the prior art.

Other objects, advantages and novel features of the invention will become more apparent from the following detailed description of the present embodiment when taken in conjunction with the accompanying drawings.

DETAILED DESCRIPTION OF THE INVENTION

Figure 1A:
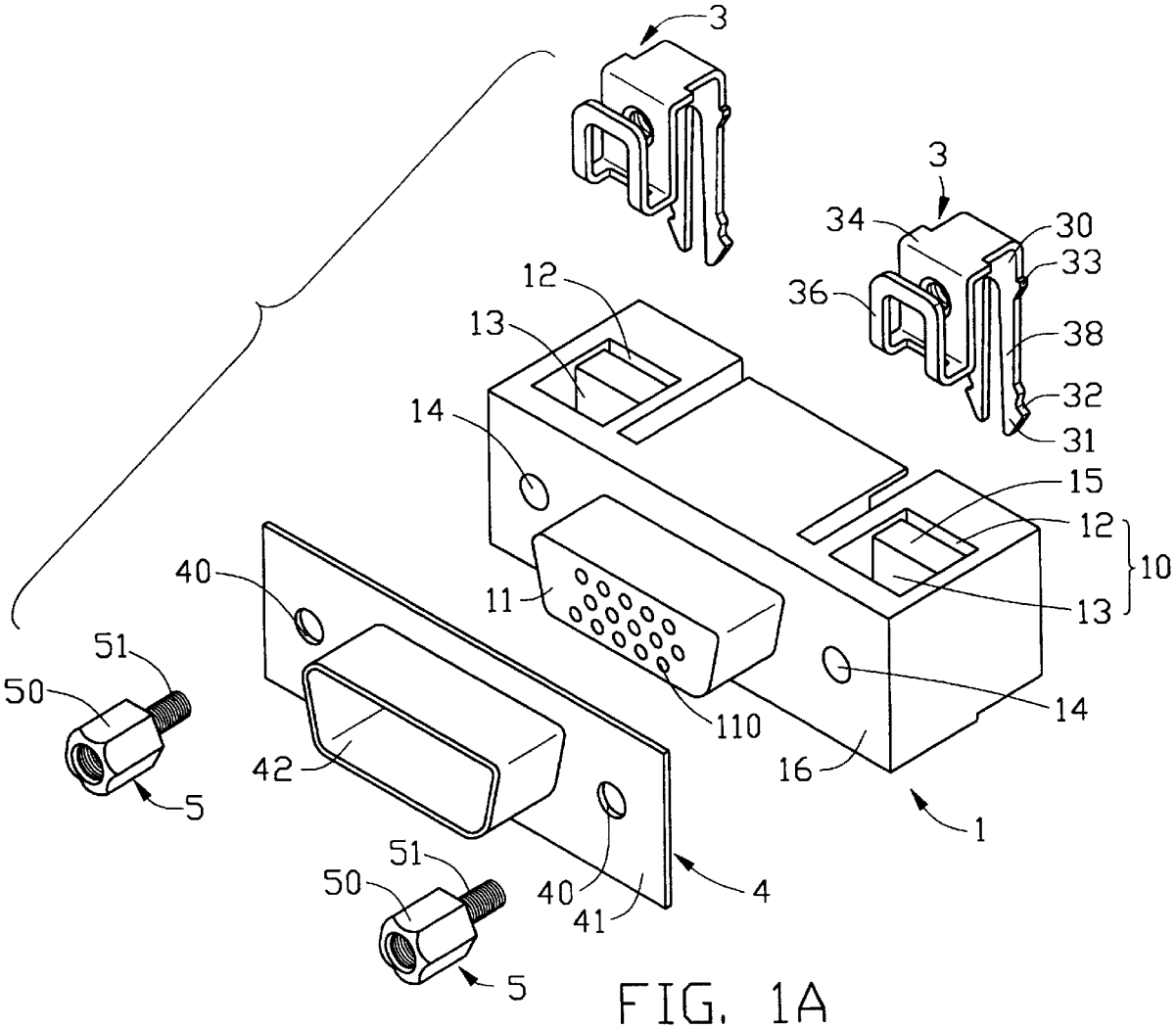
FIG. 1A is an exploded perspective view of an electrical connector in accordance with a first embodiment of the present invention.
Figure 2:
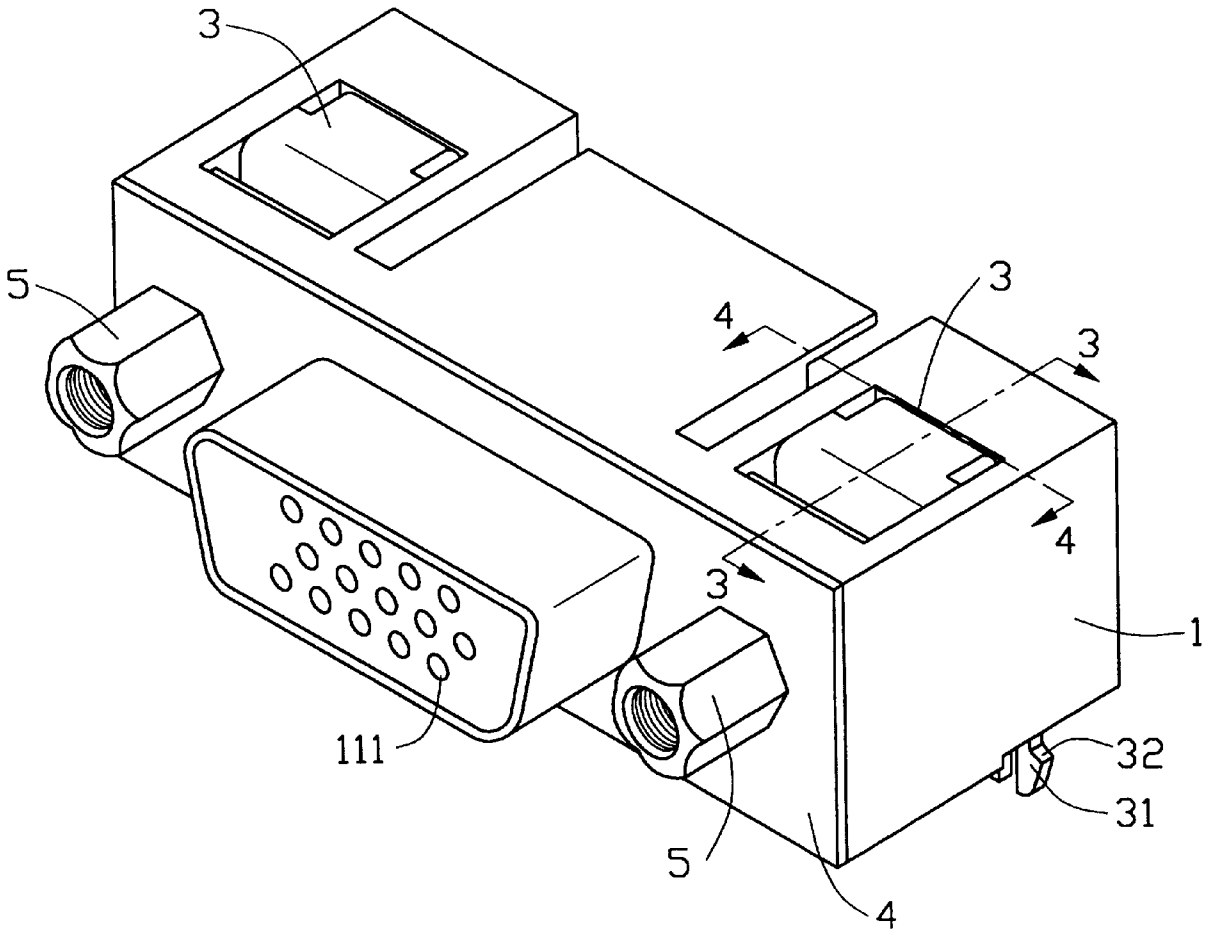
FIG. 2 is an assembled view of FIG. 1.
Figure 4:
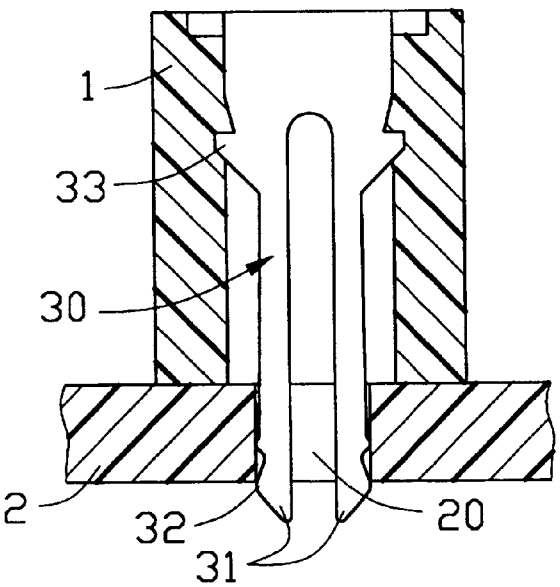
FIG. 4 is a sectional view taken along line 4—4 of FIG. 2 when the connector is mounted on a printed circuit board.
Figure 3:
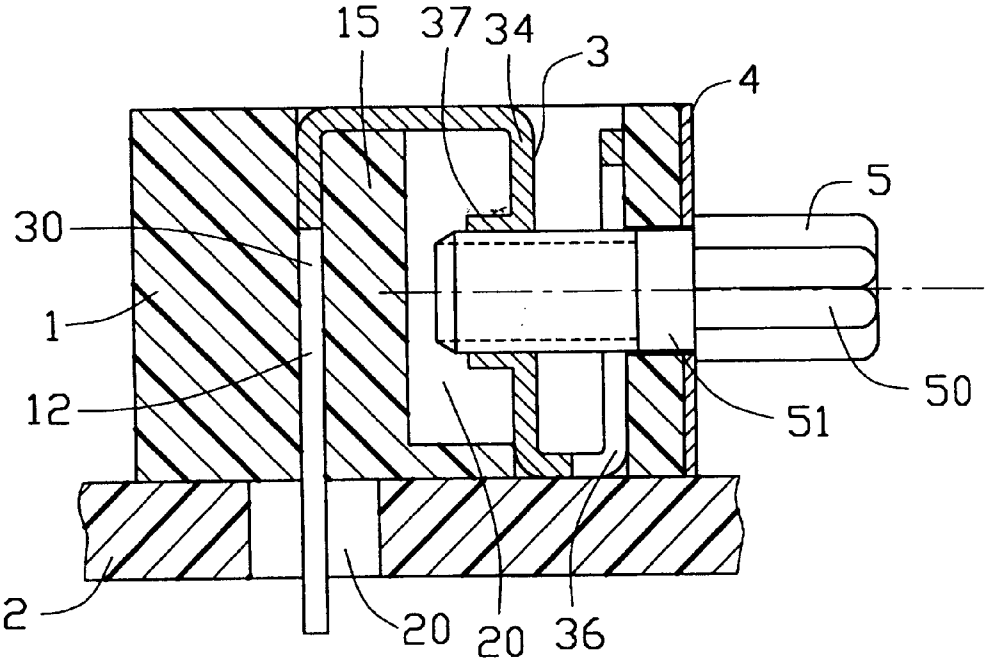
FIG. 3 is a sectional view taken along line 3—3 of FIG. 2 when the connector is mounted on a printed circuit board.
Figure 5:
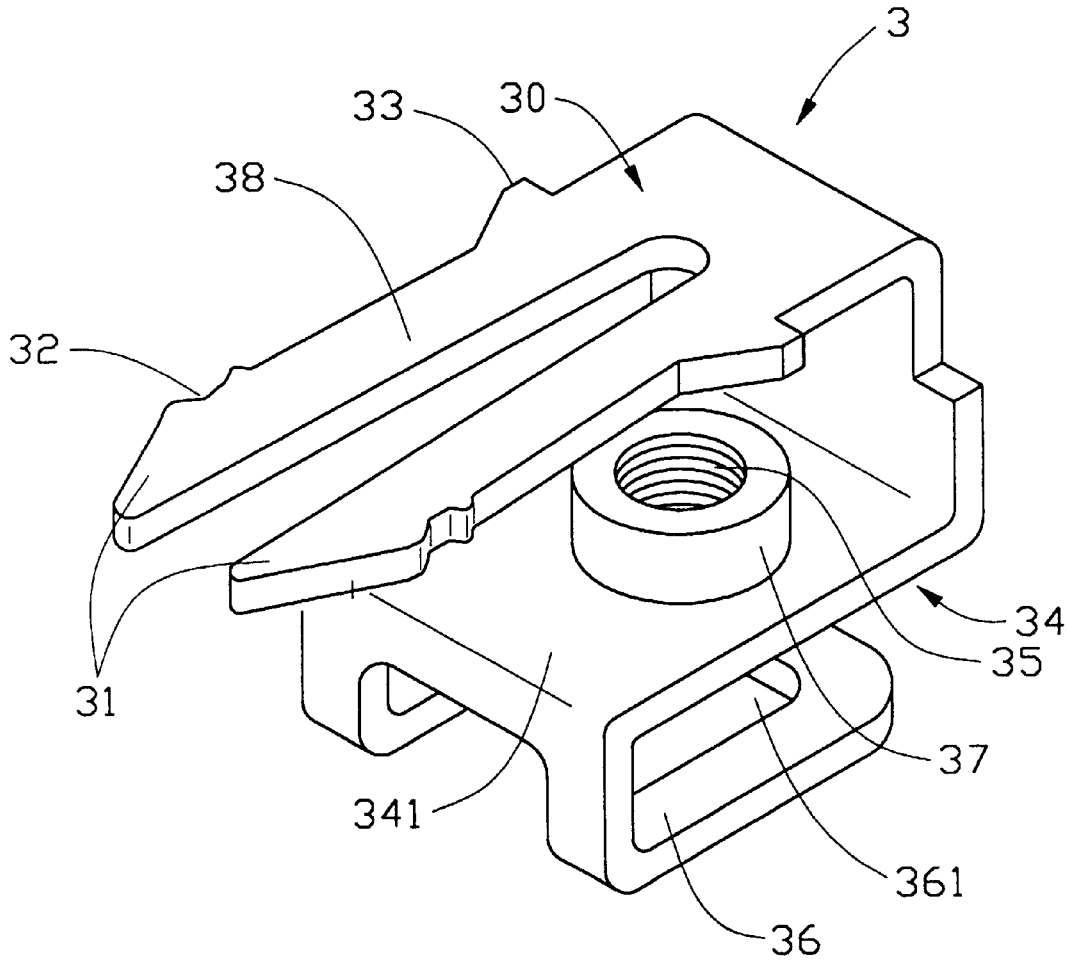
FIG. 5 is an enlarged perspective view of a boardlock in accordance with the present invention.

Referring to FIGS. 1A and 2, an electrical connector of the present invention comprises an insulative housing 1, a front shell 4, a pair of locking posts 5 and a pair of boardlocks 3. The insulative housing 1 is rectangular shaped and defines a pair of receiving recesses 10 in opposite side ends thereof. Referring to FIG. 3, the receiving recesses 10 each comprise a first slot 13 and a second slot 12. A retaining body 15 is formed by the housing 1 in the recess 10 and separates the first slot 13 from the second slot 12. The retaining body 15 is L-shaped to retain the boardlock 3. A protrusion member 11 extends forward from a front face 16 of the housing 1. A pair of holes 14 is defined in opposite sides of the front face 16 beside the protrusion member 11. The protrusion member 11 is D-shaped and defines a plurality of passageways for receiving conductive contacts (not shown) therein.

The front shell 4 forms a square shaped base 41 and a shroud 42 for enclosing the front face 16 and the protrusion member 11 of the insulative housing 1, respectively. The base 41 defines a pair of holes 40 in opposite sides thereof for aligning with the holes 14 in the front face 16 of the insulative housing 1. The shroud 42 is corresponding D-shaped and extends forward from a middle portion of the base 41.

Referring to FIG. 1A, the locking posts 5 each comprise a head 50 with an inner thread and a threaded shank 51 for locking with the boardlock 3 received in the receiving recess 10 of the insulative housing 1. Each head 50 has a hexagonal contour so that a tool, for example, a wrench, can be used to rotate the locking post 5 to cause the threaded shank 51 to threadedly engage with the boardlock 3. The inner threads in the heads 50 are used for threadedly engage with complementary structures of metallic grounding bars of a mating connector (not shown) when the connector of FIG. 1A and the mating connector are connected together.

Figure 1B:
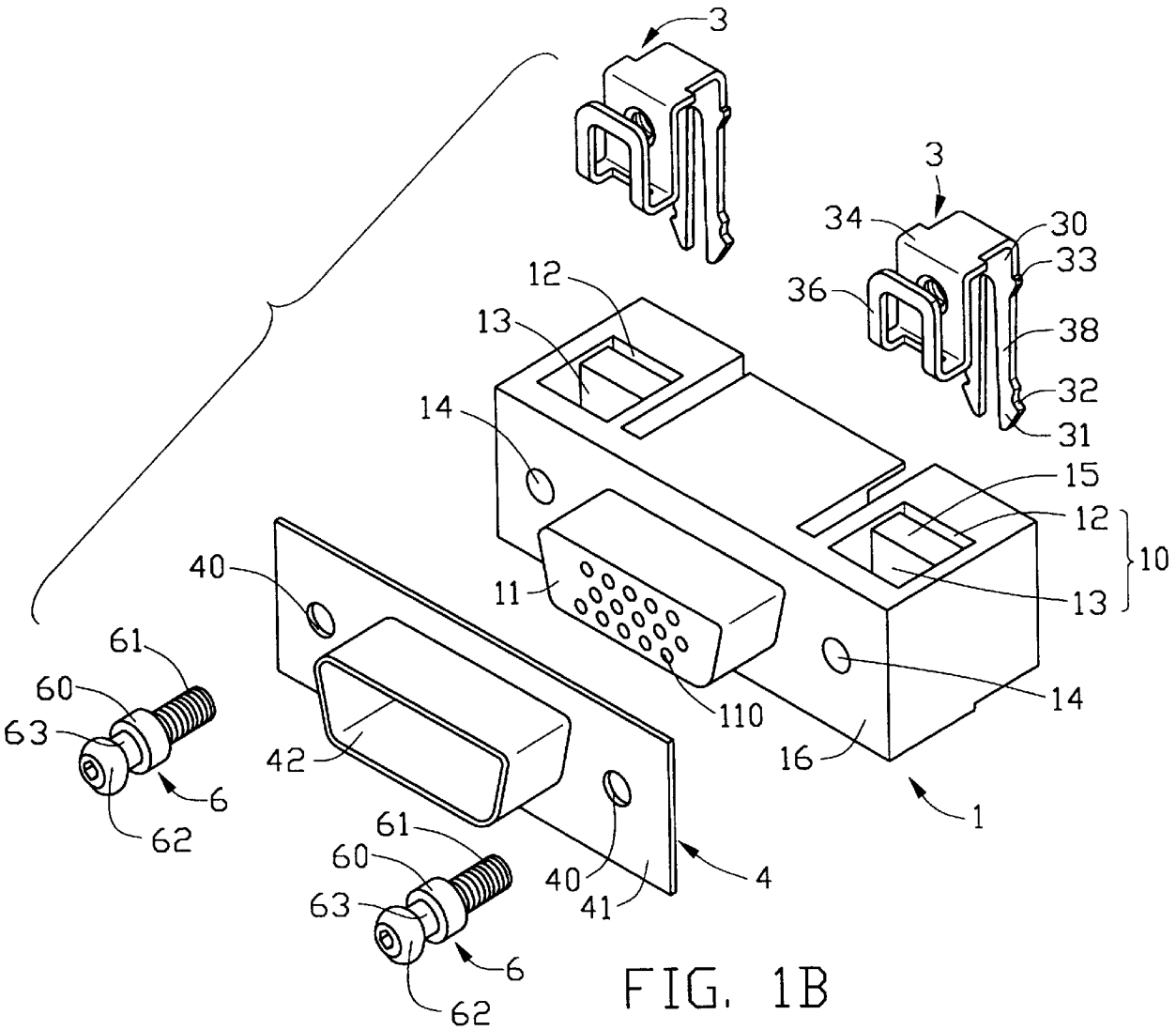
FIG. 1B is an exploded perspective view of an electrical connector in accordance with a second embodiment of the present invention.

Additionally, referring to FIG. 1B, another pair of locking posts 6 may replace the locking posts 5. The locking posts 6 each comprise a threaded shank 61 and a head portion 62 generally having a globular construction and located opposite the threaded shank 61. The threaded shank 61 is used to threadedly engage with the boardlock 3. The head portion 62 defines a hexagonal opening (not labeled) in a free end thereof for receiving a tool, for example, an Allen wrench, whereby the post 6 can be rotated to cause the threaded shank 61 to threadedly engage with the boardlock 3. A projection 60 is formed proximate the head portion 62, and a groove 63 is defined therebetween. The head portions 62 and the groove 63 are used to engage with complementary structures of a metallic grounding bar of a mating connector (not shown) when the connector of FIG. 1B and the mating connector are connected together.

Referring to FIGS. 1A through 5, the boardlocks 3 each are integrally formed by stamping a metal sheet and comprise a body section 34, a board-locking section 30 and a resilient section 36. The resilient section 36 is used to function like a washer: providing a spring force to ensure that the threaded shank 51 can securely threadedly engage with the boardlock 3. The body section 34 forms a longitudinal panel 341 and a screw portion 37. The screw portion 37 is cylindrical shaped and extends rearward from a rear surface of the panel 341. A threaded hole 35 extends through the panel 341 into the screw portion 37 of the body section 34 to threadedly engage with the threaded shank 51(61) of the locking posts 5 (6). The resilient section 36 horizontally extends forward from a bottom edge of the body section 34 and then upward at a right angle to form a vertical portion spaced from the body section 34 a distance. The resilient section 36 defines a receiving opening 361 therein. The board-locking section 30 extends horizontally rearward from a top edge of the body section 34 and then downward at a right angle to form a vertical portion spaced from the body section 34 a distance. The vertical portion of the board-locking section 30 forms a pair of insert legs 38. The insert legs 38 form a pair of latching barbs 33 at an upper part thereof and a pair of retaining bars 32 at a lower part thereof. The latching barbs 33 are used for latching in the second slot 12 in the receiving recess 10 of the insulative housing 1. The retaining barbs 32 are used for retaining in a locking hole 20 defined in a printed circuit board 2. A pair of tapering ends 31 are formed at distal ends of the insert legs 38 to facilitate insertion of the insert legs 38 into the locking hole 20 of the printed circuit board 2.

Referring to FIGS. 2 through 5, in assembly, the boardlocks 3 are inserted into the receiving recesses 10, in which the insert legs 38 of the board-locking sections 30 are received in the second slots 12, the body section 30 and the resilient section 36 are received in the first slots 13, and the retaining barbs 32 are extended beyond a bottom face of the housing 1. A rear part of a horizontal portion of the board-locking section 30 of each boardlock 3 overrides a corresponding retaining body 15. The vertical portion of the resilient section 36 of each boardlock 3 abuts against an inner surface of a front wall of the housing 1 defining the first slot 13. The front shell 4 encloses the front face 16 and the protrusion member 11 of the insulative housing 1 and the holes 40 align with the holes 14 in the insulative housing 1. The threaded shanks 51(61) of the locking posts 5(6) are inserted through the holes 40 and 14, then the receiving openings 361 and to threadedly engage with the threaded holes 35 of the body sections 34 until the heads 50 or the protrusions 60 intimately abut the front shell 4. The resilient sections 36 provide rearward force acting on the body sections 34, thereby ensuring a tight engagement between the thread on the threaded shank 51 (61) and the thread on the threaded hole 35. Therefore, the washers and nuts in the prior art can be eliminated from the present invention. Thus, the present invention can simplify the manufacture and the assembly of the electrical connector. Finally, the insert legs 38 of the boardlocks 3 are inserted into the locking holes 20 respectively in the printed circuit board 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting to a printed circuit board, comprising:

an insulative housing defining a pair of receiving recesses at opposite side ends thereof and a pair of holes, each receiving recess comprising a first slot and a second slot separated from the first slot by a retaining body formed in the receiving recess;

a plurality of conductive contacts being received in the insulative housing;

a metal shell at least partially enclosing the insulatlive housing and defining a pair of holes aligned with the pair of holes of the insulative housing;

a pair of boardlocks each being engaged in a corresponding receiving recess of the insulative housing and each including a body section defining a threaded hole, a resilient section defining an opening and a board-locking section, the body section and the resilient section received in the first slot of the receiving recess and the board-locking section received in the second slot of the receiving recess for connecting to a printed circuit board; and a pair of locking posts each comprising a threaded shank and a head portion opposite the threaded shank, the threaded shank extending through the hole in the shell and the hole of the insulative housing, then the opening of the resilient section and to engage with the threaded hole of the body section, the locking posts being turnable to move the resilient section therealong, thereby tightening the posts with respect to the boardlock;

wherein the retaining body of the insulative housing has an L-shaped cross-section;

wherein each boardlock is formed as one piece;

wherein each body section of the securing member comprises a panel and a portion, and wherein the threaded hole extends through both the panel and the protrusion;

wherein the resilient section of each boardlock extends forwardly from one end of the panel and then upwardly at a right angle;

wherein the board-locking section of each boardlock extends rearwardly from the other end of the panel and then downwardly at a right angle and forms a pair of insert legs;

wherein the pair of insert legs of the board-locking section forms a pair of retaining barbs to retain in the second slot of the receiving recess of the insulative housing;

wherein the pair of insert legs of the board-locking section forms a pair of latching barbs to latch in a locking hole defined in the printed circuit board.

* * * * *